United States Patent [19]

Fujiwara

[11] 4,373,993

[45] Feb. 15, 1983

[54] SLICE LIP FORMING A SMOOTH CONTINUOUS SURFACE

[75] Inventor: Haruyoshi Fujiwara, Mihara, Japan

[73] Assignee: Mitsubishi Jukogyo Kabushiki Kaisha, Japan

[21] Appl. No.: 237,908

[22] Filed: Feb. 25, 1981

[30] Foreign Application Priority Data

Mar. 7, 1980 [JP] Japan ..... 55-28722
Jun. 20, 1980 [JP] Japan ..... 55-83664

[51] Int. Cl.[3] ..... D21F 1/02; D21F 1/04
[52] U.S. Cl. ..... 162/347; 162/344
[58] Field of Search ..... 162/344, 345, 346, 347

[56] References Cited

U.S. PATENT DOCUMENTS 1,898,372 2/1933 Hyde ..... 162/347
2,718,824 9/1955 Hornbostel ..... 162/344
3,010,510 11/1961 Cirnito ..... 162/344
3,853,697 12/1974 Parker et al. ..... 162/344
4,050,499 9/1977 Luey et al. ..... 162/347
4,154,649 5/1979 Stutz et al. ..... 162/347

FOREIGN PATENT DOCUMENTS 1816750 9/1969 Fed. Rep. of Germany ..... 162/347

*Primary Examiner*—Steve Alvo
*Attorney, Agent, or Firm*—McGlew and Tuttle

[57] ABSTRACT

An improved slice lip applicable to a head box for a paper-making machine. The improvement includes a main body and the joint portion on the liquid-contacting side of the lip being fitted on the same plane, a neck portion having low bending rigidity in the orthogonal direction of the flow formed between the fitting portion of the lip to the main body and the tip portion of the lip in the direction of the width, and a plurality of adjusting rods connected to the tip portion of the lip which are so disposed as to be capable of adjusting a tip gap between the tip portion of the lip and its main lip in the direction of the width whereby a sheet-like jet can be obtained.

1 Claim, 8 Drawing Figures

Z
2
6
1
K
3
1
X
J
A
5
13
14

FIG. 4
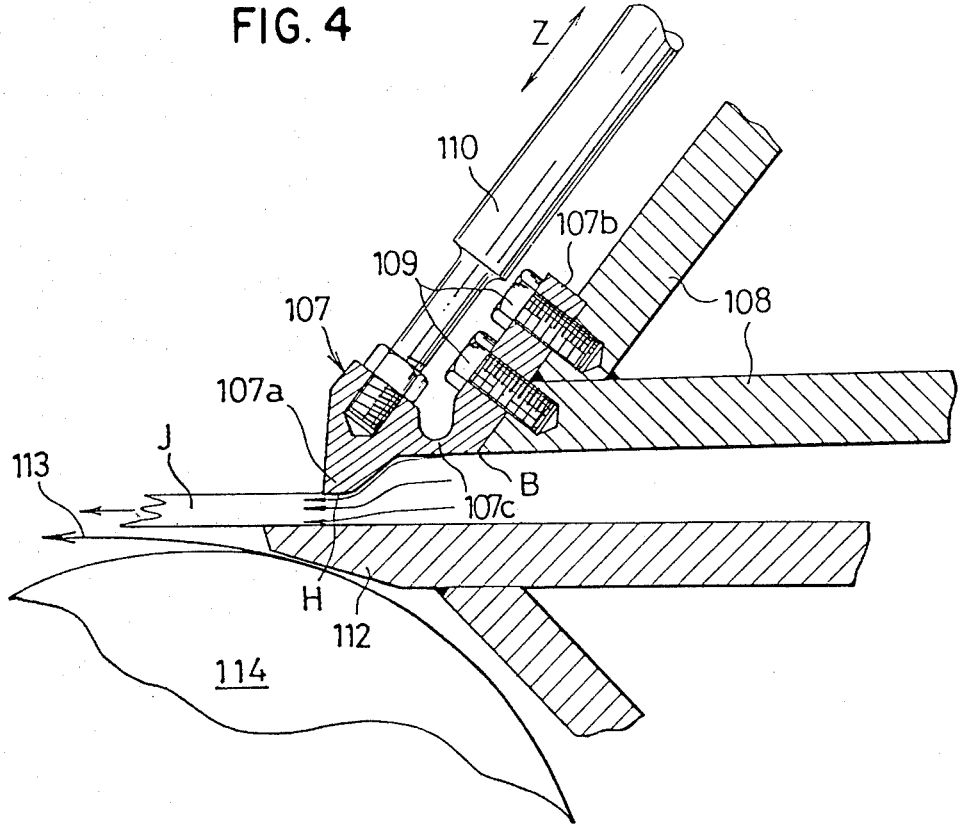
FIG. 5a
PRIOR ART
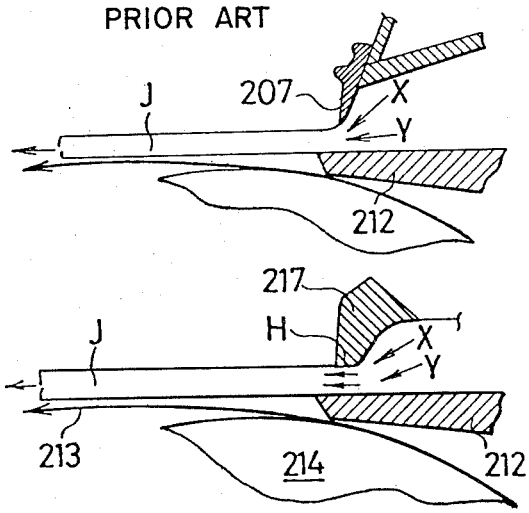
FIG. 5b
FIG. 5c
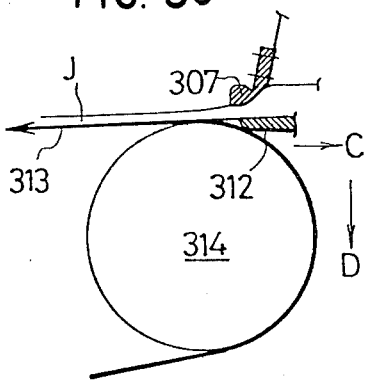

SLICE LIP FORMING A SMOOTH CONTINUOUS SURFACE

FIELD AND BACKGROUND OF THE INVENTION

This invention relates to a slice lip applicable to a head box for a paper-making machine.

FIG. 1(*a*) shows an example of the slice lip at the tip of a conventional head box. The slice lip 1 is deflected in the Z-direction by means of a jack rod 2 with a pitch of about 150 mm and an interconnecting metal 3 so that the lip opening is changed. Thus, the flow rate in the direction of the width perpendicular to the surface of drawing is also changed and fine adjustment of the weight profile in the direction of the width is effected.

In this case, pressure is applied to a liquid-contacting surface, at A, of the slice lip 1 in order to obtain a jet J whereby the slice lip 1 is likely to be forced up and off a slice body 5. To prevent this displacement, a spring 6 is provided. However, reproducibility of the fine adjustment of the slice lip 1 in the direction of the width is low partly because the sliding frictional force of the slice body 5 is increased due to the force of this spring 6, partly because there is a relative slip between the slice lip 1 and the interconnecting metal 3, partly because the slice lip has bending rigidity in the direction of the width, and so forth.

Furthermore, since there is a corner formed at the joint surface or portion A, between the slice body 5 and the liquid-contacting surface of the slice lip 1, an unsteady flow is generated. This unsteady flow not only disturbs the jet J but also collects scum at the portion A.

In this case, such turbulence which occurs on the surface of the jet J, produces streaks and the like which eventually leads to a problem in the quality of products being formed. In FIG. 1(*b*), which shows in detail the portion X in FIG. 1(*a*), the error in the flatness of the surface K at the tip of the slice lip 1 results in the error in the lip opening and invites the non-uniformity of the jet J. The reference numeral 13 (FIG. 1(*a*) designates a wire or forming wire and the reference numeral 14 designates a forming roll.

SUMMARY OF THE INVENTION

The present invention is directed to the elimination of these problems of the conventional device and to the provision of a slice lip having a construction in which the main body and the joint portion on the liquid-contacting side of the lip are fitted on the same plane. A neck portion of the device has a low rigidity for bending in the orthogonal direction of the flow and is formed in the direction of the width between a fitting portion of a tip to the main body and the tip portion of the lip. The adjustment of a tip gap between the lip and a mating lip is effected only by bending the lip on the tip side with respect to and from the neck portion by means of plural adjusting rods disposed in the direction of the width, and the liquid-contacting surface of the lip is shaped into a smooth surface so as to constantly compress the flow and have a streamline shape toward the tip. According to this construction, it is possible to prevent contamination on the back of the lip, to improve reproducibility of adjustment and to minimize jet disturbance.

Further, the present invention provides a slice lip in which, at the tip portion of the lip which is deflected to expand and narrow the gap between it and the mating lip thereby to make fine adjustment of the weight distribution in the direction of the width, there is disposed a rectifying portion having a slight compressing inclination which is parallel or which does not expand with respect to the mating lip. According to this construction, the jet can be jetted uniformly in the direction of the width and the disturbance on the jet surface can be minimized.

Hereinafter, preferred embodiments of the present invention will be described with reference to the accompanying drawings.

BRIEF DESCRIPTION OF THE DRAWINGS

FIG. 1(*b*) is a detailed view of the portion X of FIG. 1(*a*);

FIGS. 2 through 4 are sectional side views of the slice lip in accordance with the embodiments of the present invention, respectively;

FIGS. 5(*a*) is a schematic view showing the state of a jet formed by the conventional slice lip; and FIGS. 5(*b*) and 5(*c*) are schematic views showing the state of the jet by still other embodiments of the present invention, respectively.

DESCRIPTION OF THE PREFERRED EMBODIMENTS

Figures 1A, 1B:
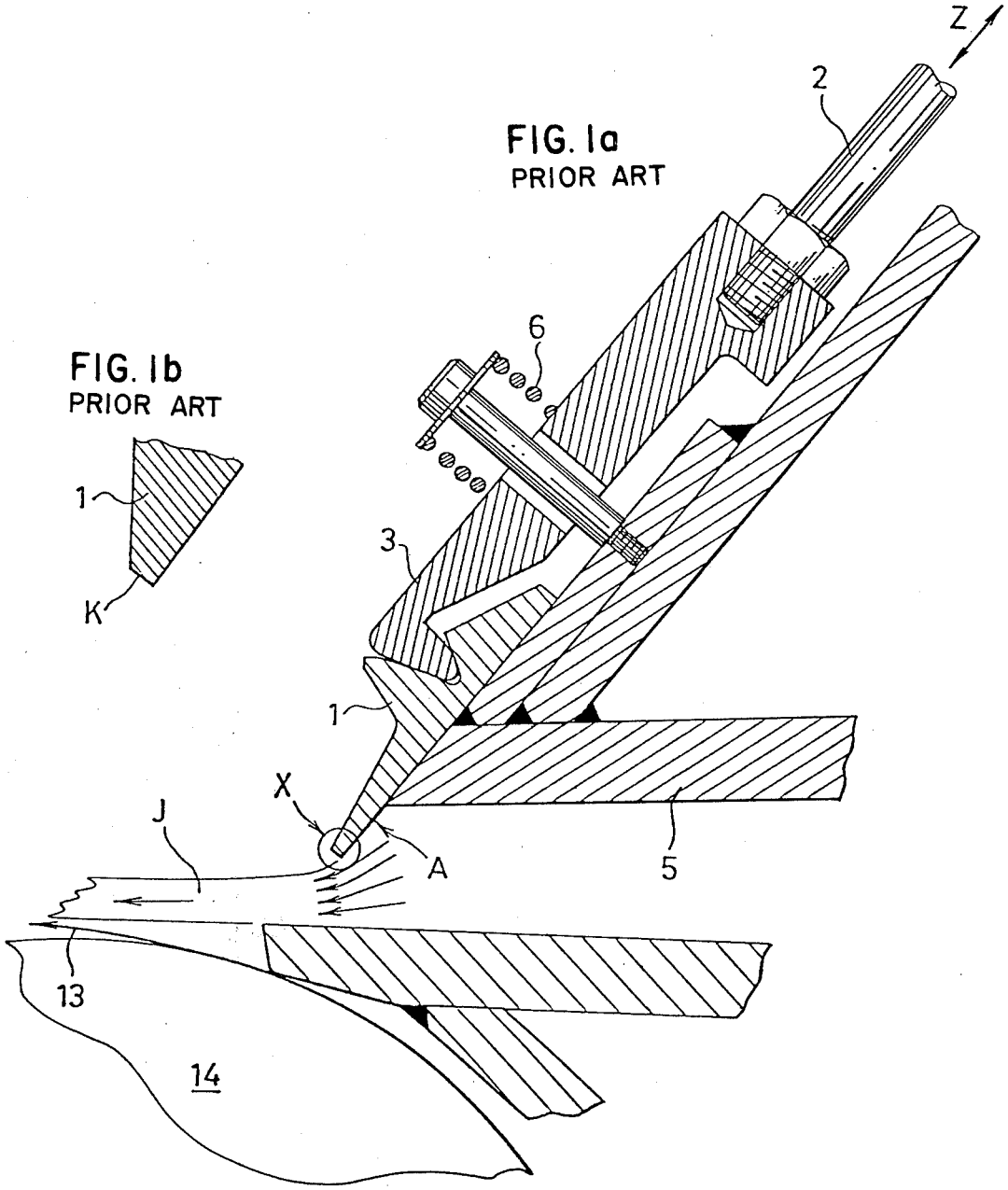
FIG. 1a PRIOR ART
FIG. 1b PRIOR ART
FIG. 1(*a*) is a sectional side view of an example of the slice lip at the tip of a conventional head box.
Figure 2:
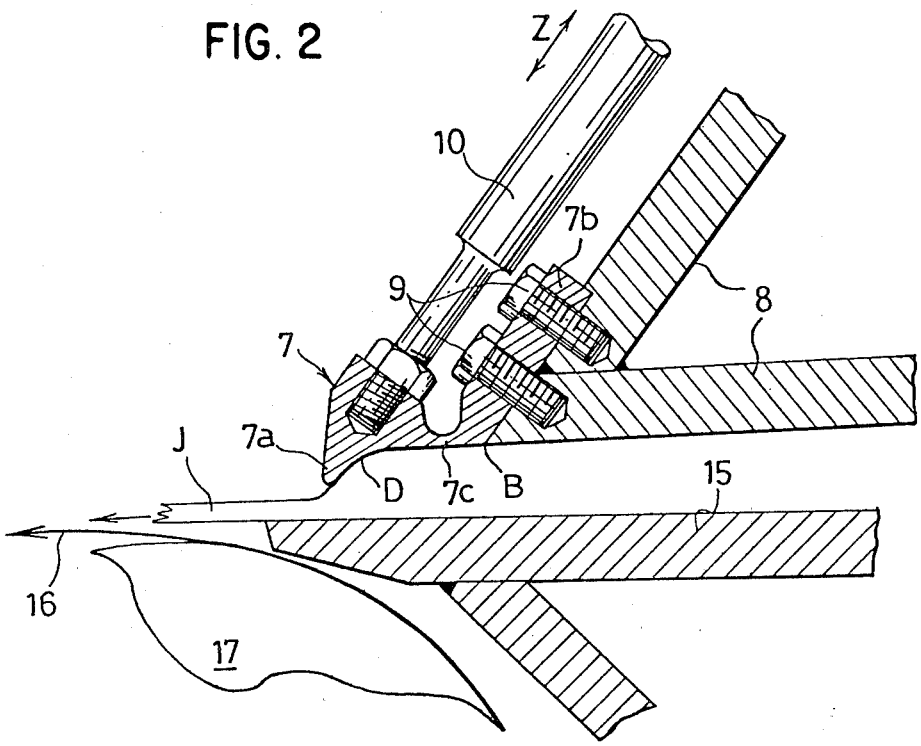
Figure 3:
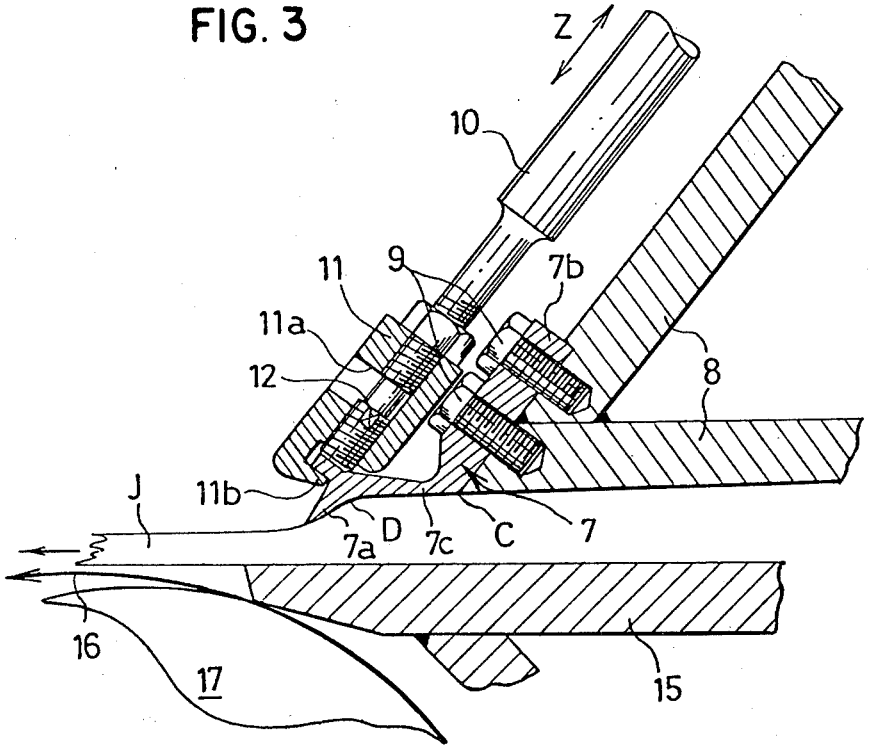

In FIGS. 2 and 3, a slice lip 7 having a tip portion 7*a*, a fitting or connecting portion 7*b* and a neck portion 7*c*, is shown fixed to a slice body 8 through the fitting portion 7*b* by means of bolts 9. A joint portion of the lip, on the liquid-contacting side thereof, is shaped into a flat surface (see reference character B in FIG. 2 and reference character C in FIG. 3). FIG. 2 shows an embodiment in which an adjusting jack rod 10 is directly fitted to the tip portion 7*a* of the slice lip 7 while FIG. 3 shows another embodiment in which the adjusting jack rod 10 is interconnected with the slice lip 7 via an interconnecting metal 11 that is divided in the direction of the width. In other words, in the embodiment shown in FIG. 3, the jack rod 10 is screwed to the slice lip 7 and at the same time, a set screw 12 is rotated from a hole 11*a* formed on the side surface of the interconnecting metal 11 so that the tip portion 11*b* of the interconnecting metal 11 and the set screw 12 clamp the slice lip 7 between them and connect the slice lip 7 to the jack rod 10.

The slice lip 7 as described above has the fitting portion 7*b* at which it is fitted to the slice body 8 by the bolts 9 and the neck portion 7*c* between the fitting portion 7*b* and the tip portion 7*a* of the slice lip. The neck portion has low bending rigidity or flexibility in the orthogonal direction with respect to the flow and as compared to the remainder of the lip. Further, the liquid-contacting surface of the slice lip 7, that is its lower surface that comes into contact with the jet flow, is formed in a smooth shape D in such a manner as to constantly compress and be streamline in shape toward the tip portion 7*a*. Further, the tip portion 7*a* of the slice lip 7 is formed in a sharp edge in such a manner as to sharply cut the water of the jet. Reference J designates the jet; reference numerals 15, a mating lip; 16, a wire or forming wire; and 17, a forming roll respectively. The construction of the interconnecting metal 11 shown in FIG. 3 is not restrictive, in particular.

Next, another embodiment of the present invention will be described. In FIG. 4, the slice lip 107 is shown fixed to slice body 108 by the bolts 109 and its joint portion B on the liquid-contacting side is shaped flat. The adjusting jack rod 110 is directly fitted to the slice lip 107.

Thus, the slice lip 107 has a neck portion 107*c* of low rigidity between the fitting portion 107*b*, at which the slice lip is fitted to the slice body 108 by the bolts 109, and the tip portion 107*a* of the slice lip. When the jack rod 110 is moved in the Z direction, the tip portion 107*a* of the slice lip 107 is so deflected as to expand the gap between it and the lower or mating lip 112, whereby the lip opening is changed and, hence, the flow rate in the direction of width, so that fine adjustment of the weight profile in the direction of the width is effected.

The slice lip 107 is further equipped with a rectifying portion H at its tip portion 107*a*, the rectifying portion H having a slight compressing inclination which is parallel or which does not expand with respect to the lower lip 112. In FIG. 4, even if the rigidity at the tip portion is increased by disposing this rectifying portion H, the adjustment of the opening in the direction of the width is not at all hindered because the neck portion 107*c* exists. The reference numeral 113 designates a wire or forming wire and the reference numeral 114 designates a forming roll respectively.

As described in detail in the foregoing, in the present invention, the joint portion of the main body and the liquid-contacting side of the lip are shaped flat. Accordingly, the flow of the raw material is hardly disturbed. Further, the neck portion having low bending rigidity in the orthogonal direction of the flow is formed in the direction of width between the fitting portion of the lip to the lip main body and the tip portion of the lip, and the plural adjusting rods connected to the tip portion of the lip are so disposed as to be capable of adjusting the tip gap between the lip tip and the mating lip in the direction of the width. According to this arrangement, the adjustment of the lip in the direction of the width is effected through the adjustment of the adjusting rod in the Z direction which bends the neck portion in the sectional direction as well as the tip portion, on the front side from the neck portion, in the direction of the width. Since this construction does not include the slide surface of the conventional device, reproducibility in the adjustment in the direction of the width can be improved.

Since the liquid-contacting surface of the lip is shaped into a smooth form in such a manner as to constantly compress the flow and be streamline toward its tip, it has no possibility of disturbing the flow and no scum is likely to deposit. Moreover, an unsteady flow occurs only with difficulty and the jet is hardly disturbed. If the lip and the adjusting rod are coupled to each other either by directly screwing the adjusting rod to the lip or via the interconnecting metal, the moving distance of the adjusting rod in the Z direction is as such transmitted to the lip.

In the present invention, there is disposed the rectifying portion having a slight compressing inclination, which is parallel or which does not expand with respect to the mating lip, at the tip portion of the lip which is deflected in such a direction as to expand or narrow the gap between it and the mating lip and which is to perform the fine adjustment of the weight distribution in the direction of the width. When the jet J is sprayed from the tip of the slice tip, the jet flow is allowed to pass between the mating lip and the rectifying portion H having a slight compressing inclination, which is parallel or which does not expand with respect to the mating lip, thereby directing the streamline flow. Thus, the jet can be stabilized and jetted smoothly.

FIG. 5(*a*) shows an embodiment in which the conventional slice lip 1 is used whereas FIG. 5(*b*) shows the embodiment in which the slice lip 217 of the present invention is used. The difference in the action and effect between them will be described by referring to these drawings. In FIG. 5(*a*), the flow in the X direction impinges against the flow in the Y direction so that turbulence occurs in the flow and due to its influence, the jet surface is rapidly disturbed. In FIG. 5(*b*), according to the slice lip 217, the flows in both X and Y directions are rectified by the rectifying portion H, having a slight inclination which is parallel or which does not expand with respect to the mating lip, and the turbulence is attenuated so that the jet is not disturbed and its flying distance is increased as shown in the drawing. The reference numeral 212 designates a lower lip or mating lip, the reference numeral 213 designates a wire or forming wire and the reference numeral 214 designates a forming roll respectively.

In FIG. 5(*c*) showing still another embodiment of the present invention, wherein a slice lip 307 is moved in the C direction as well as in the D direction. This arrangement makes it possible to reduce the impinging angle between the jet J and the wire 313 of the forming roll 314, to minimize the disturbance of the jet when the jet J gets on the wire 313 and to eliminate any collapse of the formation. The reference numeral 312 designates a lower lip.

As described above, in accordance with the present invention, jetting of the jet can be stabilized, the turbulence on the jet surface can be minimized and the occurrence of the streaks can also be minimized. In comparison with the conventional slice lip, the jet is allowed to flow out uniformly in the direction of the width if the portion of the relatively large area of the rectifying portion is uniform in the direction of the width. Unlike the conventional slice lip, the slice lip of the present invention minimizes the non-uniformity of the jet even if there is an error in the flatness of the K surface at the tip of the slice lip. This facilitates production.

In accordance with the present invention, further, since the turbulence of the jet is less and its flying distance is great, the slice lip portion can be moved in the C direction as shown in FIG. 5(*c*). It is therefore possible to increase the thickness of the lower lip and to reduce the machining strain of the lower lip, its strain due to heat and fluid pressure, and so forth.

What is claimed is:

1. A device for forming a sheet-like jet of fluid comprising:

a main body having a surface adapted to be in contact with said fluid;

a mating lip having a surface defining with said main body surface a flow passage for the fluid to flow in a flow direction;

a slice lip having a connecting portion fixed to said main body with a surface, adjacent said main body surface, to be in contact with the fluid and extending coplanar with said main body surface, said slice lip having a tip portion with a surface adapted to be in contact with the fluid and a neck portion connected between said connecting and tip portions which is flexible with respect to said connecting and tip portions and flexible in a direction orthogonal to the fluid flow direction, said neck portion having a surface adapted to be in contact with the fluid, said tip portion surface and said mating lip surface defining a gap therebetween for forming the sheet-like jet of fluid; and at least one adjusting rod connected to said tip portion which is movable to flex said neck portion and move said tip portion to change a width of said gap;

said surface of said connecting portion, said neck portion and said tip portion forming a smooth continuous surface which converges toward said mating lip surface in the fluid flow direction, in a streamline fashion toward said gap.

* * * * *